US012215876B2

(12) United States Patent
Zhou et al.

(10) Patent No.: US 12,215,876 B2
(45) Date of Patent: Feb. 4, 2025

(54) HEAT EXCHANGER FIN, HEAT EXCHANGER, INDOOR UNIT AND AIR CONDITIONER

(71) Applicants: GD MIDEA HEATING & VENTILATING EQUIPMENT CO., LTD., Foshan (CN); MIDEA GROUP CO., LTD., Foshan (CN)

(72) Inventors: Baisong Zhou, Foshan (CN); Bin Luo, Foshan (CN); Feng Li, Foshan (CN); Zhaohui Li, Foshan (CN); Kun Yang, Foshan (CN); Lin Wu, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 222 days.

(21) Appl. No.: 17/764,972

(22) PCT Filed: Mar. 2, 2020

(86) PCT No.: PCT/CN2020/077477
§ 371 (c)(1),
(2) Date: Mar. 29, 2022

(87) PCT Pub. No.: WO2021/077649
PCT Pub. Date: Apr. 29, 2021

(65) Prior Publication Data

US 2022/0404039 A1 Dec. 22, 2022

(30) Foreign Application Priority Data

Oct. 23, 2019 (CN) ..... 201911014034.5
Nov. 28, 2019 (CN) ..... 201911194822.7

(51) Int. Cl.
*F28F 1/24* (2006.01)
*F24F 1/0067* (2019.01)
(Continued)

(52) U.S. Cl.
CPC ..... *F24F 1/0067* (2019.02); *F28F 1/20* (2013.01)

(58) Field of Classification Search
CPC ..... F28F 1/24; F28F 1/28; F28F 1/30; F28F 1/32; F28F 1/0067; F28F 1/0325;
(Continued)

(56) References Cited

U.S. PATENT DOCUMENTS 2,055,549 A * 9/1936 Modine ..... F28D 1/05383 165/146
3,763,929 A * 10/1973 Wenig ..... F28F 9/262 165/181
(Continued)

FOREIGN PATENT DOCUMENTS

CN 101907374 A 12/2010
CN 103277943 A 9/2013
(Continued)

OTHER PUBLICATIONS

ISR for PCT application PCT/CN2020/077477.
(Continued)

*Primary Examiner* — Frantz F Jules
*Assistant Examiner* — Jason N Thompson

(57) ABSTRACT

Disclosed are a heat exchanger fin, a heat exchanger, an indoor unit and an air conditioner. The heat exchanger fin includes a fin body, and the fin body includes an air outlet contour line arranged on one side and an air inlet contour line arranged on the other side; refrigerant pipe mounting holes are provided in the fin body; and on a straight line where the curvature radius of the air outlet contour line of
(Continued)

the fin body is located, or on a straight line where the curvature radius of the air inlet contour line of the fin body is located, the distance between the air inlet contour line and the air outlet contour line of the fin body is gradually reduced from the middle to two ends of the heat exchanger fin.

19 Claims, 8 Drawing Sheets

(51) Int. Cl.
*F24F 1/18* (2011.01)
*F28F 1/20* (2006.01)
*F28F 1/28* (2006.01)
*F28F 1/32* (2006.01)

(58) Field of Classification Search
CPC ..... F28F 1/18; F28F 1/26; F28D 2001/0266; F28D 2001/0273; F28D 7/163
See application file for complete search history.

(56) References Cited

U.S. PATENT DOCUMENTS 4,771,825 A * 9/1988 Chen ..... F28F 1/20 165/172
5,157,941 A * 10/1992 Cur ..... F25B 39/02 165/146
5,947,195 A * 9/1999 Sasaki ..... B60H 1/00328 165/173
2006/0272349 A1* 12/2006 Ishibashi ..... F28F 1/325 62/426
2012/0006524 A1* 1/2012 Jensen ..... F28D 7/1653 165/227
2015/0226489 A1* 8/2015 Higashiiue ..... F28D 1/0478 165/104.19
2015/0323230 A1* 11/2015 Reagan ..... F28D 1/0477 165/177

FOREIGN PATENT DOCUMENTS

CN 108458621 A 8/2018
CN 108458621 B 9/2019
CN 110701941 A 1/2020
CN 110701942 A 1/2020
CN 110848814 A 2/2020
JP 08338670 A * 12/1996 ..... F28F 1/32
JP 10054685 A * 2/1998 ..... F28D 7/0066
JP 2006250366 A 9/2006
JP 2008215694 A 9/2008
JP 2010096481 A 4/2010
JP 5371365 B2 12/2013
WO 2005024309 A1 3/2005
WO WO-2010017853 A1 * 2/2010 ..... F28D 1/053
WO 2013018297 A1 2/2013

OTHER PUBLICATIONS

First Office Action for CN application 201911014034.5.
First Office Action for CN application 201911194822.7.
Search Report mailed Sep. 29, 2022 for EP application 20880266.0.

* cited by examiner

HEAT EXCHANGER FIN, HEAT EXCHANGER, INDOOR UNIT AND AIR CONDITIONER

CROSS-REFERENCES TO RELATED APPLICATIONS

The present disclosure is a national phase application of International Application No. PCT/CN2020/077477, filed on Mar. 2, 2020, which claims priority to and the benefit of the Chinese Patent Application No. 201911014034.5 filed on Oct. 23, 2019 and the Chinese Patent Application No. 201911194822.7 filed on Nov. 28, 2019, the entire contents of which are incorporated herein by reference.

FIELD

The present disclosure relates to the field of the air conditioning technology, in particular relates to a heat exchanger fin, a heat exchanger, an indoor unit, and an air conditioner.

BACKGROUND

At present, a heat exchanger fin commonly used in a heat exchanger of an indoor unit is mostly in a rectangular shape with equal widths or having a partially non-standard shaped structure at both ends of the rectangle, and the pipeline flow paths at the heat exchanger fin are also arranged uniformly according to a rule. However, air flow out of a fan of an indoor unit is generally non-uniform, which easily leads to excess air volume for some regions of the heat exchanger and also results in material waste for some regions, causing low utilization of the heat exchanger and affecting heat exchange efficiency of the air conditioner.

SUMMARY

The present disclosure aims to solve at least one problem existing in the prior art or the related art.

For this, one objective of the present disclosure is to provide a heat exchanger fin.

Another objective of the present disclosure is to provide a heat exchanger.

A further objective of the present disclosure is to provide an indoor unit.

A further objective of the present disclosure is to provide an air conditioner.

In order to achieve the above objectives, in one embodiment of the present disclosure provides in embodiments a heat exchanger fin, including: a fin body, including an air outlet contour line arranged at one side and an air inlet contour line arranged at the other side, and provided with refrigerant pipe mounting holes, and a distance between the air inlet contour line and the air outlet contour line of the fin body, on a straight line of a curvature radius of the air outlet contour line of the fin body or on a straight line of a curvature radius of the air inlet contour line of the fin body, gradually decreases from a center to flanks of the heat exchanger fin.

According to embodiments of the present disclosure, the heat exchanger fin includes a fin body; the fin body is provided with refrigerant pipe mounting holes for allowing refrigerant pipes to be mounted; the distance between the air inlet contour line and the air outlet contour line of the fin body, on the straight line of the curvature radius of the air outlet contour line of the fin body or on the straight line of the curvature radius of the air inlet contour line of the fin body, is arranged to gradually decrease from a center to flanks of the heat exchanger fin, and the fin body is of a larger area of the central region than that of the flank region, thus allowing to increase the area of the central region of the fin body where the air volume is high and to reduce the area of the flank region of the fin body where the air volume is low, to improve utilization of the fin body, enhancing heat exchange performance, and reducing energy consumption; at the same time, as the material waste for the region where the air volume is low is reduced, thus facilitating to reduction of manufacture cost.

It should be noted that an air flow out of a fan of a commonly-used air conditioner (particularly an indoor unit) is non-uniform, where the air volume of the central air flow is generally greater than that of the periphery air flow.

In addition, the heat exchanger fin in the above embodiment of the present disclosure may further have the following additional embodiments.

In the above embodiment, the fin body is a one-piece structure. It should be noted that the one-piece structure of the fin body specifically refers to a structure that is integrally formed during processing or manufacturing process. In some examples, forming integrally is achieved by cutting or tailoring a raw material.

In the above embodiment, the fin body is concave in a direction from an air inlet side to an air outlet side, and at least part of the air outlet contour line overlaps with the air inlet contour line after translation.

In this embodiment, the fin body is arranged to be concave in the direction from the air inlet side to the air outlet side, and the fin body is in a curved shape, thus allowing to enlarge a distance between the central region of the fin body and an outlet where the air flow comes from, to reduce air pressure on the heat exchanger fin; and at least part of the air outlet contour line of the fin body is arranged to overlap with the air inlet contour line after translation, to facilitate to tailoring of the fin body during processing, reduce waste material during processing and accordingly reduce manufacture cost. It would be understood that the fin body is shaped and tailored from an entire piece of raw material during manufacture and processing, therefore reducing the distance between two fins across the entire piece of raw material increases material utilization.

In the above embodiment, a first end and a second end of the air inlet contour line are connected to the air outlet contour line respectively; a maximum distance point is within ⅕ to ⅘ of the air inlet contour line along a direction from the first end to the second end of the air inlet contour line.

In this embodiment, the first end and the second end of the air inlet contour line are arranged to connect to the air outlet contour line respectively, forming a complete outer contour of the fin body; the maximum distance point is within ⅕ to ⅘ of the air inlet contour line along a direction from the first end to the second end of the air inlet contour line, so that the maximum distance is away from the first end and the second end (i.e., the maximum distance is located within the central region of the fin body, thus allowing a region with the largest area of the fin body to correspond to air flow in higher air volume, to improve utilization of the heat exchanger fin.

In the above embodiment, a straight line corresponding to the maximum distance extends along an air inlet direction for the heat exchanger fin.

In this embodiment, the straight line corresponding to the maximum distance is arranged to extend along the air inlet direction for the heat exchanger fin, so that the extending direction of the fin body is consistent with the air inlet direction, to increase a contact area for the fin body and the inlet air flow, thus facilitating to improving heat exchange efficiency. It should be noted that the air inlet direction is an overall direction of a movement trend of the inlet air flow. There is a maximum distance between the air inlet contour line and the air outlet contour line of the fin body on the straight line of the curvature radius of the air outlet contour line of the fin body or on the straight line of the curvature radius of the air inlet contour line of the fin body, where the straight line where the maximum distance is located is the straight line corresponding to the maximum distance.

In the above embodiment, the fin body is symmetrical relative to the straight line corresponding to the maximum distance.

In this embodiment, the fin body is arranged to be symmetrical relative to the straight line corresponding to the maximum distance, so that two parts of the fin body which are divided by the straight line corresponding to the maximum distance are in similar shapes, thus providing the heat exchanger including the heat exchanger fin with uniform heat exchange performance, and facilitating to tailoring the heat exchanger fin during processing.

In the above embodiment, a length of the air inlet contour line at one side of the straight line corresponding to the maximum distance is greater than a length of the air inlet contour line at the other side of the straight line corresponding to the maximum distance.

In this embodiment, the length of the air inlet contour line at one side of the straight line corresponding to the maximum distance is arranged to be greater than the length of the air inlet contour line at the other side of the straight line corresponding to the maximum distance, so that the fin body is in an essential asymmetric shape, thus allowing to increase an area of a region of the fin body where the air volume is high and to reduce an area of a region of the fin body where the air volume is low, which are arranged in accordance with different air volumes of the inlet air flow, to improve utilization of the heat exchanger fin. It would be understood that the inlet air flow is non-uniform, where the air volume within the air flow is not necessarily exactly symmetric.

In the above embodiment, the air outlet contour line includes five arc segments connected in sequence, and the adjacent arc segments are of gradually decreasing curvatures from the center to the flanks of the heat exchanger fin.

In this embodiment, the air outlet contour line is arranged to include five arc segments connected in sequence, and the adjacent arc segments are arranged to be of gradually decreasing curvatures from the center to the flanks of the heat exchanger fin, so that different parts of the fin body are provided in different shapes by varying curvatures of different arc segments, thus facilitating to shaping and tailoring of the fin body during processing in accordance with the air volume of the inlet air flow.

In the above embodiment, a plane where the air inlet direction for the fin body is located is a first plane, and a plane which is perpendicular to the first plane is a second plane; and the fin body is of a larger projection size on the second plane than that on the first plane.

In this embodiment, a plane where the air inlet direction for the fin body is located is arranged to be a first plane, and a plane which is perpendicular to the first plane is arranged to be a second plane; and the fin body is arranged to be of a larger projection size on the second plane than that on the first plane, so that the fin body can be provided with an increased angle between the air inlet contour line and the air outlet contour line, thus facilitating to increasing an contact area between the refrigerant pipe arranged at the heat exchanger fin and the inlet air flow, to improve heat exchange efficiency.

In the above embodiment, the fin body is of a larger projection size on the second plane at one side of the straight line corresponding to the maximum distance than that on the second plane at the other side of the straight line corresponding to the maximum distance.

In this embodiment, the fin body is arranged to be of a larger projection size on the second plane at one side of the straight line corresponding to the maximum distance than that on the second plane at the other side of the straight line corresponding to the maximum distance, so that the fin body is provided in an asymmetric shape, and two parts of the fin body are provided with different projection sizes on the second plane (i.e., two parts of the fin body, which are divided by the straight line corresponding to the maximum distance, are of different sizes on a plane perpendicular to the air inlet direction), thus allowing a region with a larger size of the fin body to correspond to air flow in higher air volume and allowing a region with a smaller size of the fin body to correspond to the air flow in lower air volume, which are arranged in accordance with different air volumes of the inlet air flow, to improve utilization of the fin body and increasing heat exchange efficiency.

In the above embodiment, the fin body is of a larger projection size on the first plane at one side of the straight line corresponding to the maximum distance than that on the first plane at the other side of the straight line corresponding to the maximum distance.

In this embodiment, the fin body is arranged to be of a larger projection size on the first plane at one side of the straight line corresponding to the maximum distance than that on the first plane at the other side of the straight line corresponding to the maximum distance, so that the fin body is provided in an asymmetric shape, and two parts of the fin body are provided with different projection sizes on the first plane where the air inlet direction is located, thus allowing a region with a larger size of the fin body to correspond to air flow in higher air volume and allowing a region with a smaller size of the fin body to correspond to the air flow in lower air volume, which are arranged in accordance with different air volumes of the inlet air flow, to improve utilization of the fin body and increasing heat exchange efficiency.

In the above embodiment, the heat exchanger fin is formed as an equidistant region at the center, and the distance between the air inlet contour line and the air outlet contour line is equal within the equidistant region.

In this embodiment, the heat exchanger fin is arranged to be formed as an equidistant region at the center, and the distance between the air inlet contour line and the air outlet contour line is arranged to be equal within the equidistant region, to increase the area of the region of the fin body corresponding to the inlet air flow in higher air volume, thus improving utilization of the fin body and increasing heat exchange efficiency. It would be understood that the air volume of the central air flow is same or almost same with extremely low variation.

In the above embodiment, the air inlet contour line and the air outlet contour line within the equidistant region are any one or any combination of an arc and a straight line.

In this embodiment, the air inlet contour line and the air outlet contour line within the equidistant region may be in various shapes, including any one or any combination of an arc and a straight line, where the straight line is convenient for tailing of the fin body during processing, while the arc allows the air inlet contour line and the air outlet contour line streamlined, which is beneficial to reduce the wind resistance and make the air flow more smoothly.

In the above embodiment, the number of the refrigerant pipe mounting holes is gradually decreased from the center to the flanks of the heat exchanger fin.

In this embodiment, the number of the refrigerant pipe mounting holes is arranged to gradually decrease from the center to the flanks of the heat exchanger fin, so that the region of the fin body corresponding to the inlet air flow in higher air volume is provided with more refrigerant pipes, and the region of the fin body corresponding to the inlet air flow in low air volume is provided with fewer refrigerant pipes, fully utilizing the inlet air flow and improving heat exchange efficiency, and facilitating to reducing the area of the region of the fin body corresponding to the inlet air flow in low air volume to save material.

In the above embodiment, a distance between adjacent refrigerant pipe mounting holes is positively correlated with a diameter of the refrigerant pipe mounting hole.

In this embodiment, in order to reduce mutual influence between the refrigerant pipes, adjacent refrigerant pipes are maintained at a distance. As the total area of the fin body is limited, the distance between adjacent refrigerant pipe mounting holes is arranged to be positively correlated with the diameter of the refrigerant pipe mounting hole, to arrange the refrigerant pipes in a reasonable way within the limited space. In other words, the greater a pipe diameter of the refrigerant pipe is, the farther the distance between adjacent refrigerant pipes is; and the smaller the pipe diameter of the refrigerant pipe is, the nearer between adjacent refrigerant pipes, to improve utilization of the heat exchanger fin.

In the above embodiment, an inner diameter of the refrigerant pipe mounting hole is gradually decreased from the center to the flanks of the heat exchanger fin.

In this embodiment, the inner diameter of the refrigerant pipe mounting hole is arranged to gradually decrease from the center to the flanks of the heat exchanger fin, so that the refrigerant pipes are of different pipe diameters depending on different positions where the refrigerant pipe is located at the fin body, thus allowing a refrigerant pipe with a larger pipe diameter to be arranged at the region of the fin body where the area is larger, and allowing a refrigerant pipe with a smaller pipe diameter to be arranged at the region of the fin body where the area is lower, to facility improving of the utilization of the heat exchange fin, enhancing heat exchange performance, and reducing energy consumption; at the same time, as the material waste for the region where the air volume is low is reduced, thus facilitating to reduction of manufacture cost.

The fin body may be a one-piece structure, or may also be a split combined structure. It should be note that the one-piece structure of the fin body specifically refers to a structure that is integrally formed during processing or manufacturing process. In some examples, forming integrally is achieved by cutting or tailoring a raw material.

In the above embodiment, the distance between the air inlet contour line and the air outlet contour line of the fin body corresponding to the refrigerant pipe mounting hole is positively correlated with an internal diameter of each refrigerant pipe mounting hole, on a straight line of a curvature radius of the air outlet contour line of the fin body or on a straight line of a curvature radius of the air inlet contour line of the fin body.

In this embodiment, the distance between the air inlet contour line and the air outlet contour line of the fin body corresponding to the refrigerant pipe mounting hole is arranged to be positively correlated with an internal diameter of each refrigerant pipe mounting hole on the straight line of the curvature radius of the air outlet contour line of the fin body or on the straight line of the curvature radius of the air inlet contour line of the fin body. In other words, the greater the distance between the air inlet contour line and the air outlet contour line of the fin body is, the larger the internal diameter of the corresponding refrigerant pipe mounting hole is, so that the pipe diameter of the refrigerant pipe to be mounted in the refrigerant pipe mount hole is accordingly larger; vice versa, the smaller the distance between the air inlet contour line and the air outlet contour line of the fin body is, the smaller the internal diameter of the corresponding refrigerant pipe mounting hole is, so that the pipe diameter of the refrigerant pipe to be mounted in the refrigerant pipe mount hole is accordingly smaller, thus fully utilizing the fin body depending on the areas of different regions, arranging matching refrigerant pipe mounting holes for the corresponding part, to improve utilization of the heat exchanger fin, enhancing heat exchange performance and reducing energy consumption when the heat exchanger fin is mounted with the refrigerant pipes matching with the refrigerant pipe mounting holes.

In the above embodiment, an internal diameter of each refrigerant pipe mounting hole is linear-positively correlated with a distance of circle centers between any two adjacent refrigerant pipe mounting holes, on a straight line of a curvature radius of the air outlet contour line of the fin body or on a straight line of a curvature radius of the air inlet contour line of the fin body.

In this embodiment, the internal diameter of each refrigerant pipe mounting hole is arranged to be linear-positively correlated with a distance of circle centers between any two adjacent refrigerant pipe mounting holes, on the straight line of the curvature radius of the air outlet contour line of the fin body or on the straight line of the curvature radius of the air inlet contour line of the fin body, so that the internal diameter of the refrigerant pipe mounting hole is arranged depending on the distance of circle centers between any two adjacent refrigerant pipe mounting holes. In other words, the greater the distance of circle centers between two adjacent refrigerant pipe mounting holes is, the larger the internal diameter of the refrigerant pipe mounting hole is; vice versa, the smaller the distance of circle centers between two adjacent refrigerant pipe mounting holes is, the smaller the internal diameter of the refrigerant pipe mounting hole is, so that adjacent refrigerant pipe mounting holes are maintained at a proper distance of circle centers, to improve utilization of the heat exchanger fin, enhancing heat exchange performance and reducing energy consumption when the heat exchanger fin is mounted with the refrigerant pipes matching with the refrigerant pipe mounting holes. It would be understood that an over large distance of circle centers between adjacent refrigerant pipe mounting holes will easily lead to insufficient heat exchange for the refrigerant pipe that influences the heat exchange efficiency; an over close distance of circle centers between adjacent refrigerant pipe mounting holes will easily lead to material waste for the refrigerant pipe and also lead to an over small area of a region of the fin body between two adjacent refrigerant pipe mounting holes, resulting in easy break and thus adversely affecting reliability of the heat exchanger fin.

In some embodiments, the present disclosure provides in embodiments a heat exchanger, including: the heat exchanger fins as described in any one of embodiments, which are arranged side by side, and a distance between any two adjacent heat exchanger fins is not less than a preset interval; and a refrigerant pipe, and a pipe diameter of the refrigerant pipe fits with a size of a refrigerant pipe mounting hole of the heat exchanger fin, and the refrigerant pipe passes through the refrigerant pipe mounting hole.

According to embodiments of the disclosure, the heat exchanger includes the heat exchanger fins as described in any one of embodiments in the disclosure and a refrigerant pipe, where the heat exchanger fins is arranged side by side, forming an array of the heat exchanger fins; and the pipe diameter of the refrigerant pipe fits with the size of the refrigerant pipe mounting hole. The refrigerant pipe mounting holes arranged at the array of the heat exchanger fins are provided with the refrigerant pipes, thus allowing heat exchange between the refrigerant pipes and the inlet air flow, to achieve adjustment of air temperature. The heat exchanger in this embodiment has all beneficial advantages as described for the heat exchanger fin as described in any one of embodiments of the present disclosure, which is not elaborated in detail here.

In some embodiments, the present disclosure provides in embodiments an indoor unit, including: a shell, provided with an air inlet and an air outlet; a fan, arranged inside the shell; and the heat exchanger as described in embodiments, which is arranged inside the shell and arranged corresponding to the fan.

According to embodiments of the disclosure, the indoor unit includes a shell, a fan and the heat exchanger as described in embodiments in the disclosure, where the shell is provided with an air inlet and an air outlet, thus forming an air flow channel inside the shell; the fan is arranged inside the shell, to drive air to flow from the air inlet to the air outlet by means of rotation of the fan; and the heat exchanger is arranged correspondingly to the fan inside the shell, where in specific, the heat exchanger is arranged between the fan and the air outlet of the shell, and the fan drives air to flow to the heat exchanger for heat exchange before discharge from the air outlet of the shell, thus achieving adjustment of air temperature. The indoor unit in this embodiment has all beneficial advantages as described for the heat exchanger as described in embodiments in the present disclosure, which is not elaborated in detail here.

In embodiments of the present disclosure provides in embodiments an air conditioner, including an outdoor unit; and the indoor unit as described in embodiments which is connected to the outdoor unit.

According to embodiments in the disclosure, the air conditioner includes an outdoor unit and the indoor unit as described in the embodiments, which is connected to the outdoor unit, so that various air conditioning modes can be realized through refrigerant interaction between the outdoor unit and the indoor unit. The air conditioner in this embodiment has all beneficial advantages as described for the indoor unit as described in embodiments in of the present disclosure, which is not elaborated in detail here.

BRIEF DESCRIPTION OF THE DRAWINGS

The above embodiments of the present disclosure will be described with the following description for embodiments by combining the accompanying drawings.

The correspondence between reference signs and components in FIG. 1 to FIG. 7 is as follows.

1 fin body; 11 refrigerant pipe mounting hole; 12 air inlet contour line; 13 air outlet contour line; 14 distance maximum point; 15 process notch; 16 equidistant region; 17 first position point; 2 heat exchanger; 3 fan; 4 shell; 41 air outlet; 5 waste region; 61 first plane; 62 second plane.

DETAILED DESCRIPTION OF THE DISCLOSURE

In order to understand the above objectives, features and advantages of the present disclosure more clearly, the present disclosure will be further described in detail below in conjunction with the accompanying drawings and specific embodiments. It should be noted that embodiments and features in embodiments of the present disclosure can be combined with each other without conflict.

In the following description, many specific details are set forth in order to fully understand the present disclosure. However, the present disclosure can also be implemented in other ways different from those described herein. Therefore, the protection scope of the present disclosure is not limited by the specific embodiments disclosed below.

A heat exchanger fin, a heat exchanger, an indoor unit, and an air conditioner are described below according to some embodiments of the present disclosure with reference to FIG. 1 to FIG. 7.

Embodiment 1

Figure 1:
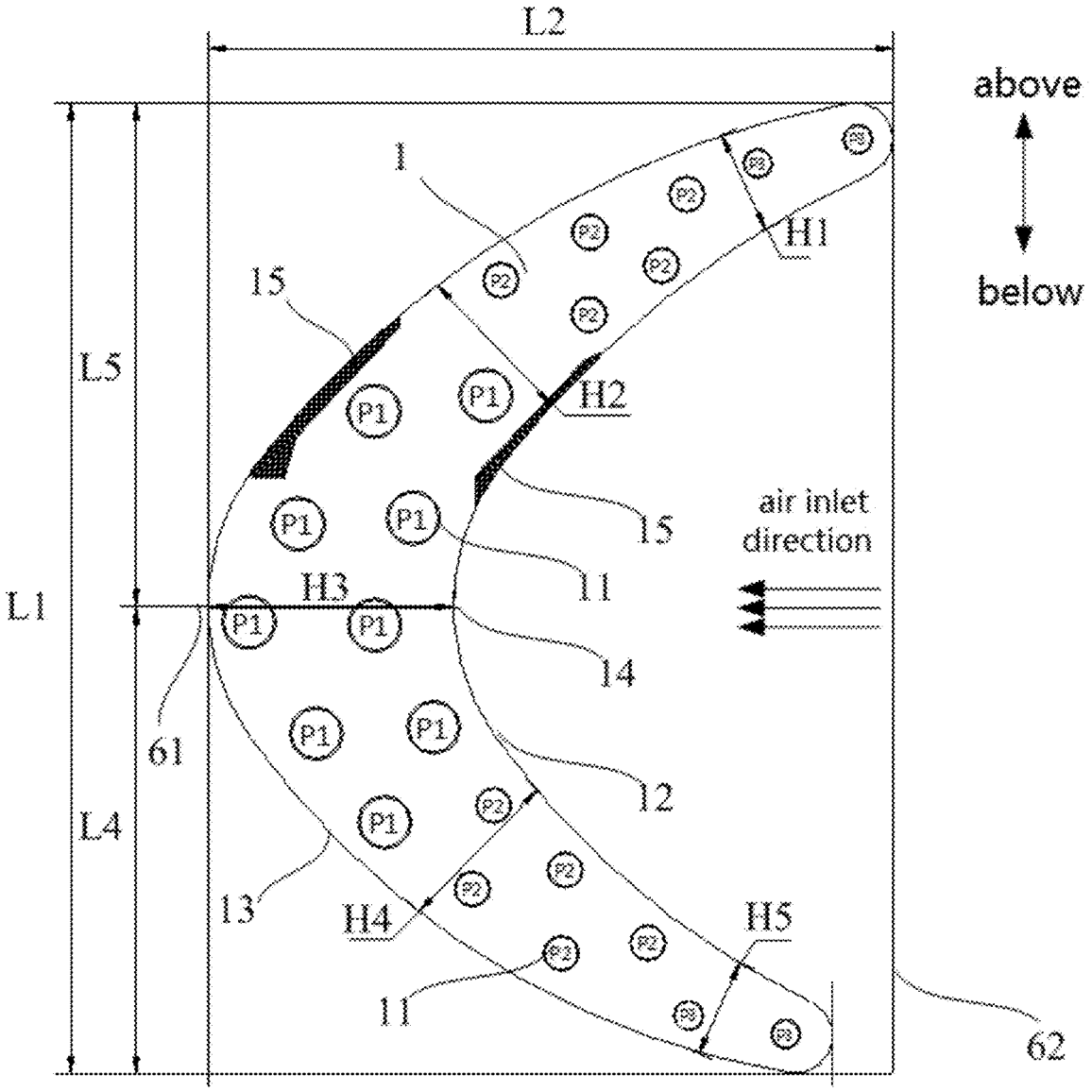
FIG. 1 shows a schematic structural view of a heat exchanger fin according to an embodiment of the present disclosure.

In this embodiment, there is provided a heat exchanger fin. As shown in FIG. 1, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipes. It should be noted that, as shown in FIG. 1, the air inlet contour line 12 and the air outlet contour line 13 of the fin body 1 each are provided with a process notch 15, to facilitate tailoring of the fin body 1 during processing.

Embodiment 2

Figure 2:
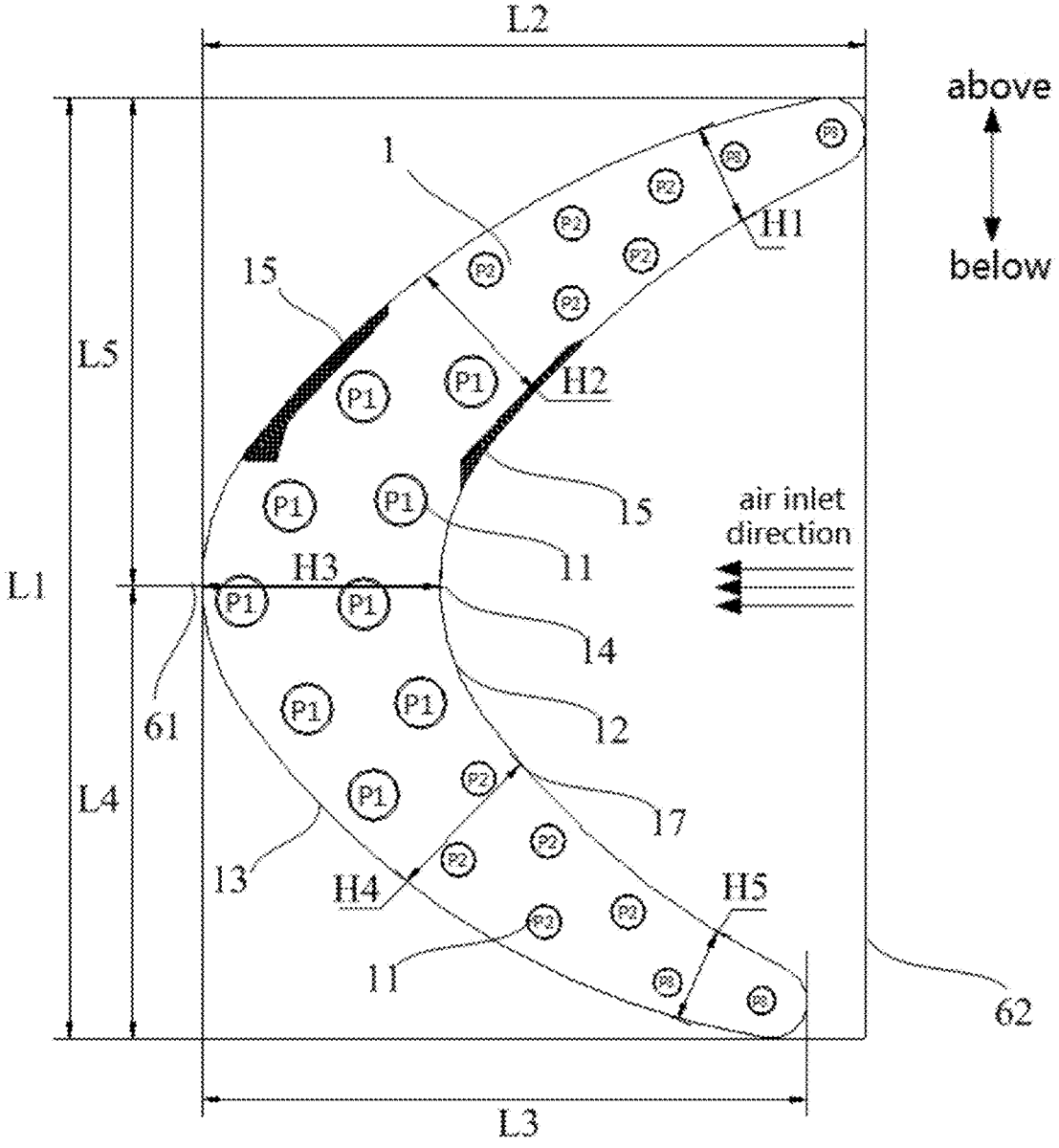
FIG. 2 shows a schematic structural view of a heat exchanger fin according to an embodiment of the present disclosure.

In this embodiment, there is provided a heat exchanger fin. As shown in FIG. 2, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the distance between the air inlet contour line 12 and the air outlet contour line 13 of the fin body 1 corresponding to the refrigerant pipe mounting hole 11 is positively correlated with the internal diameter of the refrigerant pipe mounting hole 11. The air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. In addition, at the maximum distance point 14, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H3, corresponding to which the internal diameter of the refrigerant pipe mounting hole 11 is P1; while at a first position point 17, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H4, corresponding to which the internal diameter of the refrigerant pipe mounting hole 11 is P2, where H3>H4 and P1>P2. In other words, the longer the distance between the air inlet contour line 12 and the air outlet contour line 13 of the fin body 1 is, the larger the internal diameter of the corresponding refrigerant pipe mounting hole 11 is. It should be noted that, as shown in FIG. 2, the air inlet contour line 12 and the air outlet contour line 13 of the fin body 1 each are provided with a process notch 15, to facilitate tailoring of the fin body 1 during processing.

Embodiment 3

Figure 3:
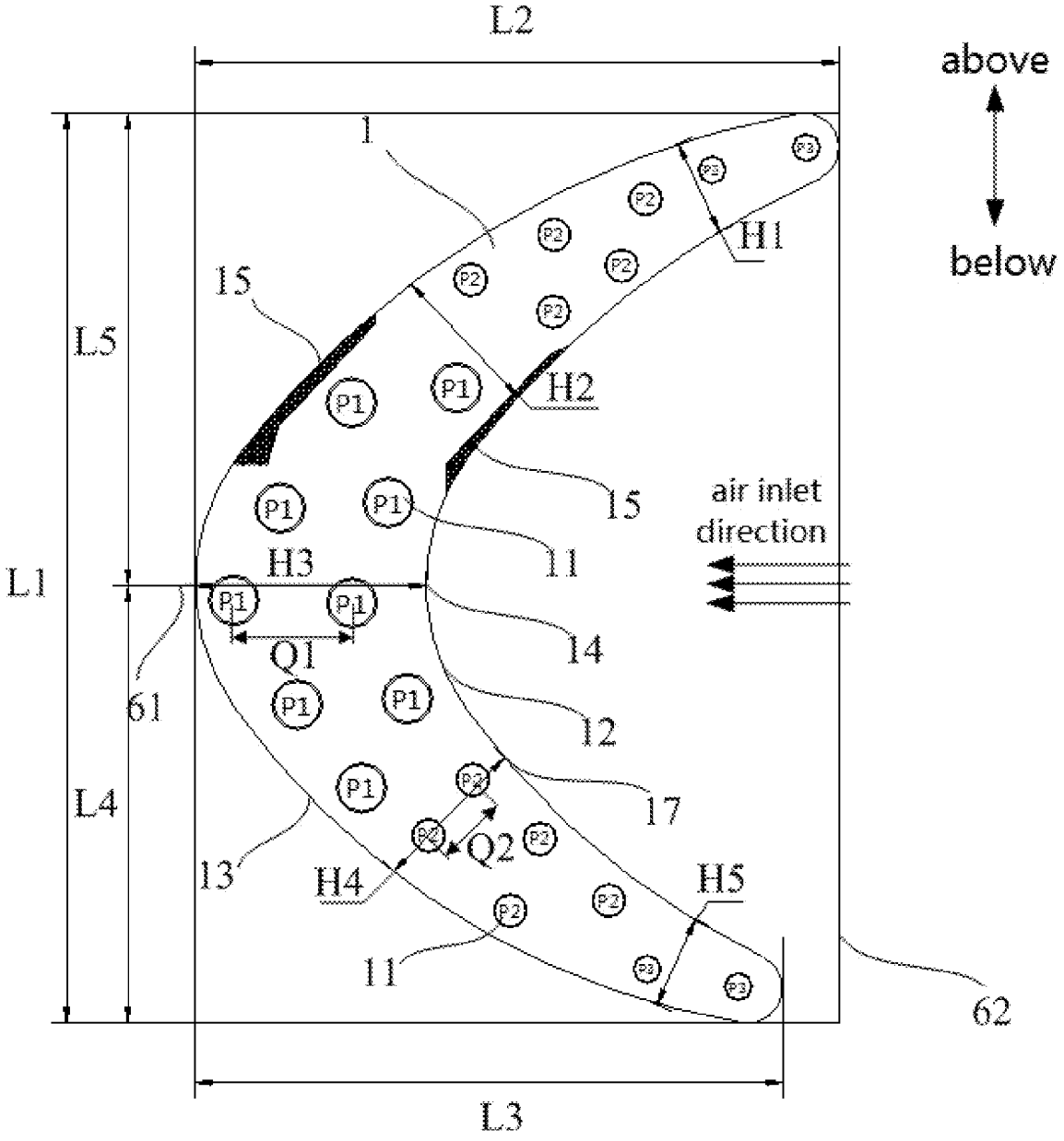
FIG. 3 shows a schematic structural view of a heat exchanger fin according to an embodiment of the present disclosure.

In this embodiment, there is provided a heat exchanger fin. As shown in FIG. 3, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1 on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the internal diameter of each refrigerant pipe mounting hole 11 is linear-positively correlated with a distance of circle centers between any two adjacent refrigerant pipe mounting holes 11. The air inlet contour line 12 and the air outlet contour line 13 are connected by arcs at the flanks of the heat exchanger fin.

There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. In addition, at the maximum distance point 14, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H3; the distance of circle centers between two adjacent refrigerant pipe mounting holes 11 is Q1, corresponding to which the internal diameter of the refrigerant pipe mounting hole is P1; while at a first position point 17, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H4; the distance of circle centers between two adjacent refrigerant pipe mounting holes 11 is Q2, corresponding to which the internal diameter of the refrigerant pipe mounting hole is P2, where H3>H4, Q1>Q2 and P1>P2. In other words, the longer the distance between the air inlet contour line 12 and the air outlet contour line 13 of the fin body 1 is, the greater the distance of circle centers between adjacent refrigerant pipe mounting holes 11 is, and the larger the internal diameter of the corresponding refrigerant pipe mounting hole 11 is. It should be noted that, as shown in FIG. 3, the air inlet contour line 12 and the air outlet contour line 13 of the fin body 1 each are provided with a process notch 15, to facilitate tailoring of the fin body 1 during processing.

Embodiment 4

In this embodiment, there is provided a heat exchanger fin. As shown in FIG. 1, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe.

Figure 4:
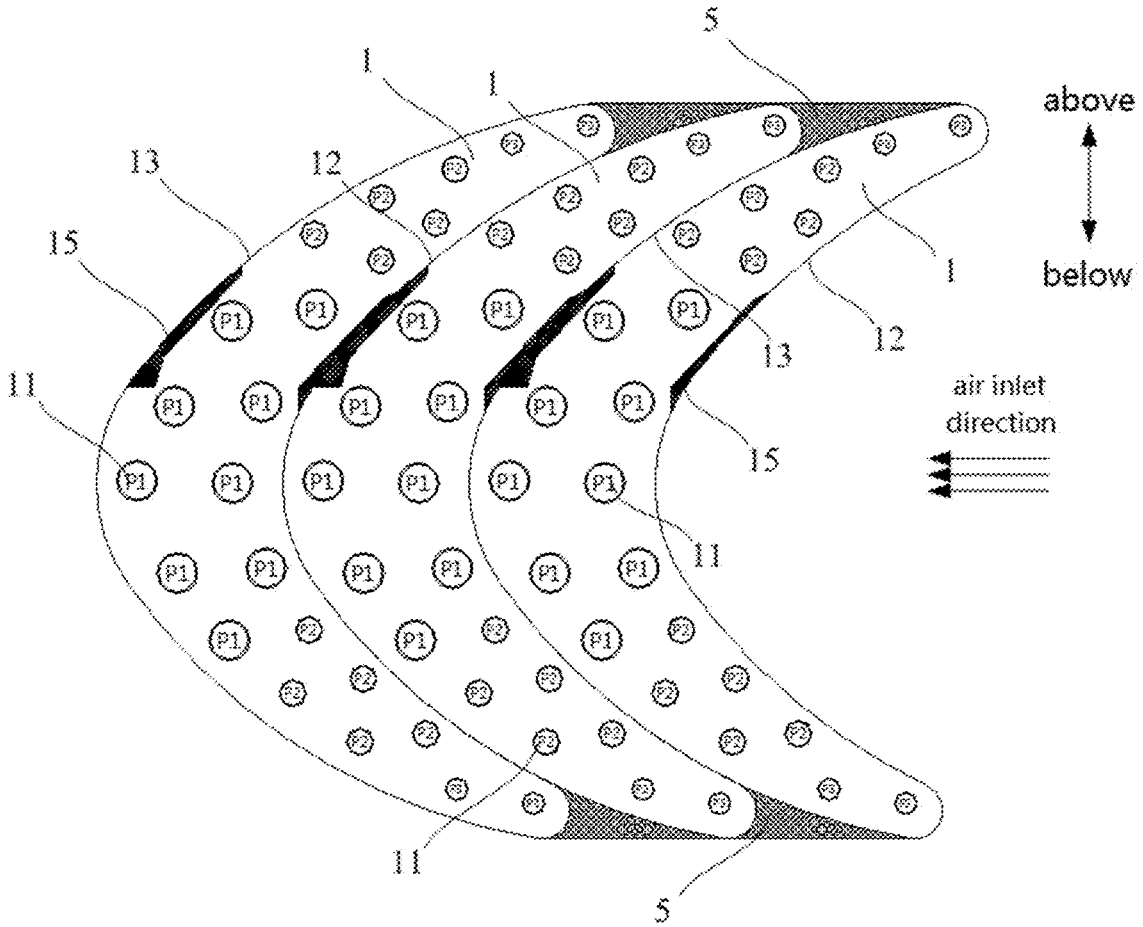
FIG. 4 shows a schematic structural view of a processing layout of heat exchanger fins according to an embodiment of the present disclosure.

As shown in FIG. 4, the air inlet contour line 12 of the fin body 1 overlaps with part of the air outlet contour line 13 after translation, to minimize an area of a waste region between two adjacent fin bodies 1 in an entire piece of raw material when processing the fin body 1, with the waste region 5 only existing between the flanks of adjacent fin bodies 1, thus facilitating to improve material utilization and reducing manufacture cost. The air inlet contour line 12 and the air outlet contour line 13 of the fin body 1 each are provided with a process notch 15, to facilitate tailoring of the fin body 1 during processing. The process notch 15 at the air inlet contour line 12 of each fin body 1 corresponds to the process notch 15 at the air outlet contour line 13 of the adjacent fin body 1, for easy tailoring during processing.

In the present embodiment, during manufacture of the heat exchanger fin, a waste rate can be controlled below 6%, which is even lower than that of traditional non-standard shaped tailoring from a rectangle slice.

Embodiment 5

In this embodiment, there is provided a heat exchanger fin. As shown in FIG. 1, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe.

As shown in FIG. 4, the air inlet contour line 12 and the air outlet contour line 13 of the fin body 1 each are provided with a process notch 15, to facilitate tailoring of the fin body 1 during processing. The air inlet contour line 12 of the fin body 1 exactly overlaps with part of the air outlet contour line 13 after translation, to minimize an area of a waste region between two adjacent fin bodies 1 in an entire piece of raw material when processing the fin body 1, with the waste region 5 only existing between the flanks of adjacent fin bodies 1.

As shown in FIG. 1, the entire length of the air inlet contour line 12 of the fin body 1 is divided unequally by the straight line corresponding to the maximum distance, where one part length of the air inlet contour line 12 that is above the straight line corresponding to the maximum distance is longer than the other part length of the air inlet contour line 12 that is below the straight line corresponding to the maximum distance. Accordingly, one part length of the air outlet contour line 13 of the fin body 1 that is above the straight line corresponding to the maximum distance is longer than the other part length of the air outlet contour line 13 that is below the straight line corresponding to the maximum distance. In some examples, the air inlet contour line 12 of the fin body 1 includes five arc segments connected in sequence, and the adjacent arc segments are of gradually decreasing curvatures from the center to the flanks of the heat exchanger fin; accordingly, the air outlet contour line 13 also includes five arc segments connected in sequence, and each arc segment of the air outlet contour line 13 is of a curvature identical to that of the corresponding arc segment of the air inlet contour line 12, and the fin body 1 is divided into five regions with different curvatures from above to below. On the straight line of the curvature radius of the air outlet contour line 13 of the fin body 1, H1, H2, H3, H4 and H5 are respective distances between the air inlet contour line 12 and the air outlet contour line 13 within the five regions, H1<H2<H3, and H5<H4<H3.

In some examples, a plane where the air inlet direction for the fin body 1 is located is referred to as a first plane 61, i.e., the horizontal plane as shown in FIG. 1 is the first plane 61; a plane which is perpendicular to the first plane 61 is a second plane 62, i.e., the vertical plane as shown in FIG. 1 is the second plane 62. The fin body 1 is of a projection size L1 on the second plane 62; the part of the fin body 1 above the straight line corresponding to the maximum distance is of a projection size L2 on the first plane 61 and a projection size L5 on the second plane 62; and the part of the fin body 1 below the straight line corresponding to the maximum distance is of a projection size L3 on the first plane 61 and a projection size L4 on the second plane 62, where L3<L2<L1 and L4<L5.

It should be noted that, for the heat exchanger fin in this embodiment, the related projection size may also comply with L2≤L3 and/or L5≤L4. In some examples, the fin body 1 may also be symmetrical relative to the straight line corresponding to the maximum distance.

On the straight line of the curvature radius of the air outlet contour line 13 of the fin body 1 or on the straight line of the curvature radius of the air inlet contour line 12 of the fin body 1, there is the maximum distance between the air inlet contour line 12 and the air outlet contour line 13 of the fin body 1. The straight line where the maximum distance is located is the straight line corresponding to the maximum distance.

Embodiment 6

Figure 5:
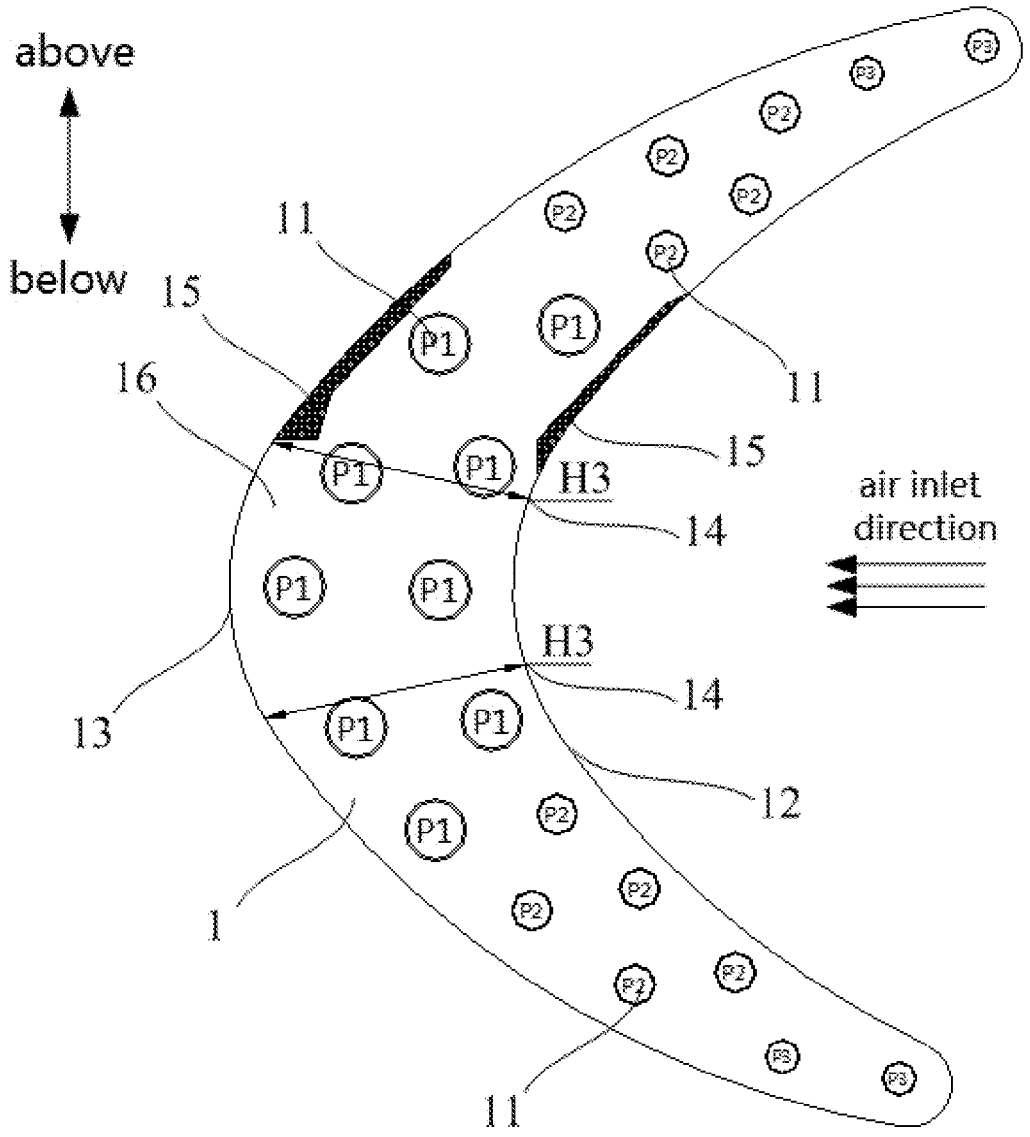
FIG. 5 shows a schematic structural view of a heat exchanger fin according to an embodiment of the present disclosure.

In this embodiment, there is provided a heat exchanger fin. As shown in FIG. 5, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. The heat exchanger fin is formed as an equidistant region 16 at the center. Within the equidistant region 16, the distance between the air inlet contour line 12 and the air outlet contour line 13 is equal on the straight line of the curvature radius of the air outlet contour line 13 of the fin body 1. In other words, there are more than one maximum distance H3 between the air inlet contour line 12 and the air outlet contour line 13; and all maximum distance points 14 are within ⅕ to ⅘ of the air inlet contour line 12 along a first end to a second end of the air inlet contour line 12. In specific, the air inlet contour line 12 and the air outlet contour line 13 within the equidistant region 16 are arcs, which are concave in the direction from the air inlet side to the air outlet side. The equidistant region 16 is located at the center where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. It should be noted that, as shown in FIG. 5, the air inlet contour line 12 and the air outlet contour line 13 of the fin body 1 each are provided with a process notch 15, to facilitate tailoring of the fin body 1 during processing.

Embodiment 7

Figure 6:
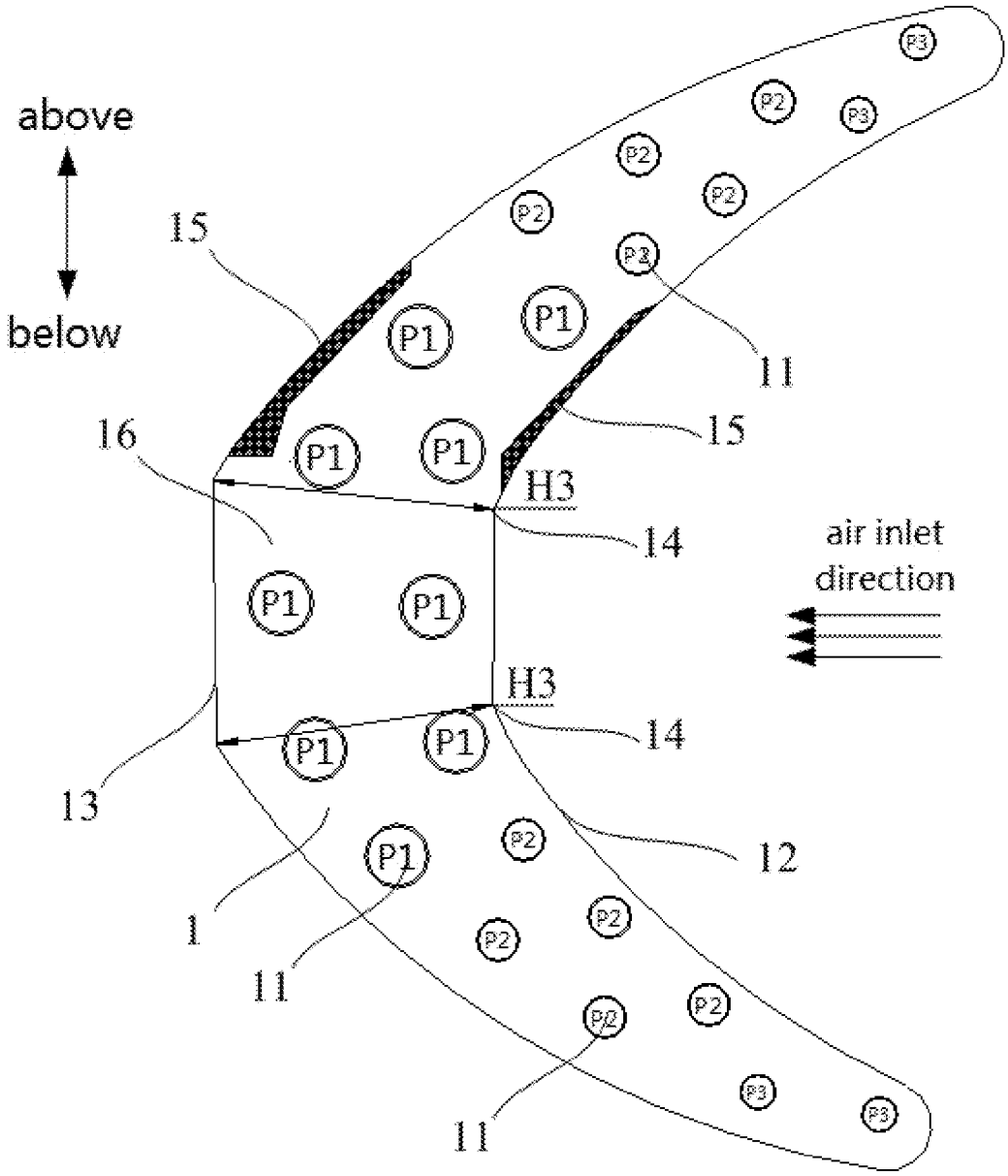
FIG. 6 shows a schematic structural view of a heat exchanger fin according to an embodiment of the present disclosure.

In this embodiment, there is provided a heat exchanger fin. As shown in FIG. 6, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. The heat exchanger fin is formed as an equidistant region 16 at the center. Within the equidistant region 16, the distance between the air inlet contour line 12 and the air outlet contour line 13 is equal on the straight line of the curvature radius of the air outlet contour line 13 of the fin body 1. In other words, there are more than one maximum distance H3 between the air inlet contour line 12 and the air outlet contour line 13; and all maximum distance points 14 are within ⅕ to ⅘ of the air inlet contour line 12 along a first end to a second end of the air inlet contour line 12. In specific, the air inlet contour line 12 and the air outlet contour line 13 within the equidistant region 16 are straight lines, which are perpendicular to an air inlet direction. The equidistant region 16 is located at the center where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. It should be noted that, as shown in FIG. 6, the air inlet contour line 12 and the air outlet contour line 13 of the fin body 1 each are provided with a process notch 15, to facilitate tailoring of the fin body 1 during processing.

Embodiment 8

In this embodiment, there is provided a heat exchanger fin. As shown in FIG. 1, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; and the air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin. In specific, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. A distance between adjacent refrigerant pipe mounting holes 11 is positively correlated with a diameter of the refrigerant pipe mounting hole 11, i.e., the larger the diameter of the refrigerant pipe mounting hole 11 is, the longer the distance between adjacent refrigerant pipe mounting holes 11 is.

As shown in FIG. 4, the air inlet contour line 12 of the fin body 1 exactly overlaps with part of the air outlet contour line 13 after translation, to minimize an area of a waste region between two adjacent fin bodies 1 in an entire piece of raw material when processing the fin body 1, with the waste region 5 only existing between the flanks of adjacent fin bodies 1. The air inlet contour line 12 and the air outlet contour line 13 of the fin body 1 each are provided with a process notch 15. The process notch 15 at the air inlet contour line 12 of each fin body 1 corresponds to the process notch 15 at the air outlet contour line 13 of the adjacent fin body 1, for easy tailoring during processing.

As shown in FIG. 1, the entire length of the air inlet contour line 12 of the fin body 1 is divided unequally by the straight line corresponding to the maximum distance, where one part length of the air inlet contour line 12 that is above the straight line corresponding to the maximum distance is longer than the other part length of the air inlet contour line 12 that is below the straight line corresponding to the maximum distance. Accordingly, one part length of the air outlet contour line 13 of the fin body 1 that is above the straight line corresponding to the maximum distance is longer than the other part length of the air outlet contour line 13 that is below the straight line corresponding to the maximum distance. In specific, the air inlet contour line 12 of the fin body 1 includes five arc segments connected in sequence, and the adjacent arc segments are of gradually decreasing curvatures from the center to the flanks of the heat exchanger fin; accordingly, the air outlet contour line 13 of the fin body 1 also includes five arc segments connected in sequence, and each arc segment of the air outlet contour line 13 is of a curvature identical to that of the corresponding arc segment of the air inlet contour line 12, and the fin body 1 is divided into five regions with different curvatures from above to below. On the straight line of the curvature radius of the air outlet contour line 13 of the fin body 1, H1, H2, H3, H4 and H5 are respective distances between the air inlet contour line 12 and the air outlet contour line 13 within the five regions, where H3 is the maximum distance, H1<H2<H3, and H5<H4<H3. Further, a plane where the air inlet direction for the fin body 1 is located is referred to as a first plane 61, i.e., the horizontal plane as shown in FIG. 1 is the first plane 61, a plane perpendicular to the first plane 61 is a second plane 62, i.e., the vertical plane as shown in FIG. 1 is the second plane 62. The fin body 1 is of a projection size L1 on the second plane 62; the part of the fin body 1 above the straight line corresponding to the maximum distance is of a projection size L2 on the first plane 61 and a projection size L5 on the second plane 62; and the part of the fin body 1 below the straight line corresponding to the maximum distance is of a projection size L3 on the first plane 61 and a projection size L4 on the second plane 62, where L3<L2<L1 and L4<L5.

It should be noted that, for the heat exchanger fin in this embodiment, the related projection size may also comply with L2≤L3 and/or L5≤L4. In some example, the fin body 1 may also be symmetrical relative to the straight line corresponding to the maximum distance.

On the straight line of the curvature radius of the air outlet contour line 12 of the fin body or on the straight line of the curvature radius of the air inlet contour line of the fin body, there is the maximum distance between the air inlet contour line and the air outlet contour line of the fin body. The straight line where the maximum distance is located is the straight line corresponding to the maximum distance.

Embodiment 9

In this embodiment, there is provided a heat exchanger fin. As shown in FIG. 1, the heat exchanger fin includes an integrally-formed fin body 1. The fin body 1 includes an air outlet contour line 13 arranged at one side and an air inlet contour line 12 arranged at the other side; and the fin body 1 is provided with refrigerant pipe mounting holes 11 for allowing refrigerant pipes to be mounted. The fin body 1 is concave in a direction from an air inlet side to an air outlet side, forming a curved shape. The distance between the air inlet contour line 12 and the air outlet contour line 13 of the fin body 1, on a straight line of a curvature radius of the air outlet contour line 13 of the fin body 1 or on a straight line of a curvature radius of the air inlet contour line 12 of the fin body 1, gradually decreases from a center to flanks of the heat exchanger fin. Accordingly, an internal diameter of the refrigerant pipe mounting hole 11 also gradually decreases from the center to the flanks of the heat exchanger fin; the distance between the air inlet contour line 12 and the air outlet contour line 13 of the fin body 1 corresponding to the refrigerant pipe mounting hole 11 is positively correlated with the internal diameter of the refrigerant pipe mounting hole 11; and the internal diameter of each refrigerant pipe mounting hole 11 is linear-positively correlated with a distance of circle centers between any two adjacent refrigerant pipe mounting holes 11. The air inlet contour line 12 and the air outlet contour line 13 are connected by arcs at the flanks of the heat exchanger fin. There is a unique maximum value H3 for the distance between the air inlet contour line 12 and the air outlet contour line 13 of the fin body 1. Along a direction from a first end to a second end of the air inlet contour line 12, the maximum distance point 14 is within ⅕ to ⅘ of the air inlet contour line 12; and a straight line where the maximum distance point 14 is located extends along an air inlet direction for the heat exchanger fin.

In specific, as shown in FIG. 3, the maximum distance point 14 is located within a region where an air volume of an inlet air flow is maximum, thus allowing to increase a size of a region of the fin body 1 where the air volume is high and to reduce a size of a region of the fin body 1 where the air volume is low, to improve utilization of the fin body 1, so that heat transfer efficiency is improved when the fin body 1 is provided with the refrigerant pipe. In addition, at the maximum distance point 14, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H3, corresponding to which the internal diameter of the refrigerant pipe mounting hole 11 is P1, and the distance of circle centers between two adjacent refrigerant pipe mounting holes 11 is Q1; while at a first position point 17, on the straight line of the curvature radius of the air outlet contour line 13 of the fin body 1 or on the straight line of the curvature radius of the air inlet contour line 12 of the fin body 1, the distance between the air inlet contour line 12 and the air outlet contour line 13 of the fin body 1 is H4, corresponding to which the internal diameter of the refrigerant pipe mounting hole 11 is P2, and the distance of circle centers between two adjacent refrigerant pipe mounting holes 11 is Q2, where H3>H4, P1>P2 and Q1>Q2. In other words, the longer the distance between the air inlet contour line 12 and the air outlet contour line 13 of the fin body 1 is, the greater the distance of circle centers between two adjacent refrigerant pipe mounting holes 11 is, and the larger the internal diameter of the corresponding refrigerant pipe mounting hole 11 is.

As shown in FIG. 4, the air inlet contour line 12 of the fin body 1 exactly overlaps with part of the air outlet contour line 13 after translation, to minimize an area of a waste region between two adjacent fin bodies 1 in an entire piece of raw material when processing the fin body 1, with the waste region 5 only existing between the flanks of adjacent fin bodies 1. The air inlet contour line 12 and the air outlet contour line 13 of the fin body 1 each are provided with a process notch 15. The process notch 15 at the air inlet contour line 12 of each fin body 1 corresponds to the process notch 15 at the air outlet contour line 13 of the adjacent fin body 1, for easy tailoring during processing.

As shown in FIG. 1, the entire length of the air inlet contour line 12 of the fin body 1 is divided unequally by the straight line corresponding to the maximum distance, where one part length of the air inlet contour line 12 that is above the straight line corresponding to the maximum distance is longer than the other part length of the air inlet contour line 12 that is below the straight line corresponding to the maximum distance. Accordingly, one part length of the air outlet contour line 13 of the fin body 1 that is above the straight line corresponding to the maximum distance is longer than the other part length of the air outlet contour line 13 that is below the straight line corresponding to the maximum distance. In specific, the air inlet contour line 12 of the fin body 1 includes five arc segments connected in sequence, and the adjacent arc segments are of gradually decreasing curvatures from the center to the flanks of the heat exchanger fin; accordingly, the air outlet contour line 13 also includes five arc segments connected in sequence, and each arc segment is of a curvature identical to that of the corresponding arc segment at the air inlet contour line 12, and the fin body 1 is divided into five regions with different curvatures from above to below. On the straight line of the curvature radius of the air outlet contour line 13 of the fin body 1, H1, H2, H3, H4 and H5 are respective distances between the air inlet contour line 12 and the air outlet contour line 13 within the five regions, where H3 is the maximum distance, H1<H2<H3, and H5<H4<H3. Further, a plane where the air inlet direction for the fin body 1 is located is referred to as a first plane 61, i.e., the horizontal plane as shown in FIG. 1 is the first plane 61, a plane which is perpendicular to the first plane 61 is a second plane 62, i.e., the vertical plane as shown in FIG. 1 is the second plane 62. The fin body 1 is of a projection size L1 on the second plane 62; the part of the fin body 1 above the straight line corresponding to the maximum distance is of a projection size L2 on the first plane 61 and a projection size L5 on the second plane 62; and the part of the fin body 1 below the straight line corresponding to the maximum distance is of a projection size L3 on the first plane 61 and a projection size L4 on the second plane 62, where L3<L2<L1 and L4<L5.

It should be noted that, for the heat exchanger fin in this embodiment, the related projection size may also comply with L2≤L3 and/or L5≤L4. In some examples, the fin body 1 may also be symmetrical relative to the straight line corresponding to the maximum distance.

On a straight line of the curvature radius of the air outlet contour line 13 of the fin body 1 or on a straight line of the curvature radius of the air inlet contour line 12 of the fin body 1, there is the maximum distance between the air inlet contour line 12 and the air outlet contour line 13 of the fin body 1. The straight line where the maximum distance is located is the straight line corresponding to the maximum distance.

Embodiment 10

In this embodiment, there is provided a heat exchanger, including the heat exchanger fins as defined in any one of embodiments 1 to 9 and a refrigerant pipe. the heat exchanger fins is arranged side by side, and a distance between any two adjacent heat exchanger fins is not less than a preset interval, to guarantee normal circulation of the inlet air flow. The pipe diameter of the refrigerant pipe fits with a diameter of a refrigerant pipe mounting hole 11 of the heat exchanger fin. The refrigerant pipe is arranged passing through the refrigerant pipe mounting hole 11, thus allowing heat exchange of air when the inlet air flow becomes in contact with the heat exchanger, achieving heat exchange by the heat exchanger. The heat exchanger in this embodiment has all beneficial advantages as described for the heat exchanger fin as described in any one of the above embodiments 1 to 9, which is not elaborated in detail here.

Embodiment 11

Figure 7:
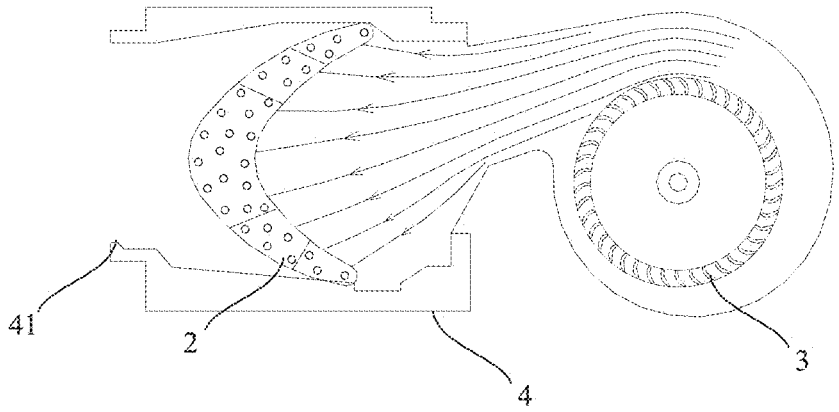
FIG. 7 shows a schematic diagram of an internal structure of an indoor unit according to an embodiment of the present disclosure.
Figure 8:
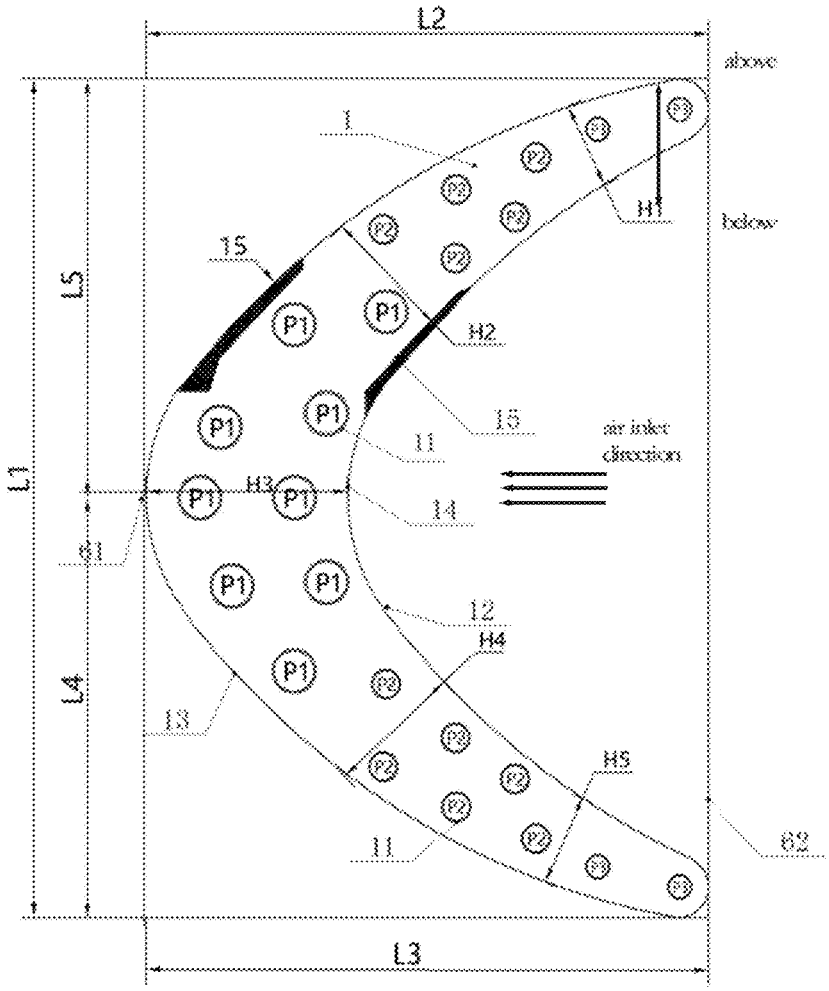
FIG. 8 shows a schematic structural view of a heat exchanger fin according to an embodiment of the present disclosure.

In this embodiment, there is provided an indoor unit. As shown in FIG. 7, the indoor unit includes a shell 4, a fan 3 and the heat exchanger 2 as described in the above embodiment 10. The shell 4 is provided with an air inlet (not shown in FIG. 7) and an air outlet 41; the fan 3 and the heat exchanger 2 are arranged within the shell 4, where the fan 3 drives air to flow from the air inlet to the air outlet 41. The heat exchanger 2 is arranged between the fan 3 and the air outlet 41 of the shell 4, and the heat exchanger 2 is arranged correspondingly to the fan 3, allowing heat exchange for the air flow send by the fan 3 before discharge from the air outlet 41 of the shell 4, thus achieving adjustment of air temperature. The indoor unit in this embodiment has all beneficial advantages as described for the heat exchanger 2 as described in the above embodiment 10, which is not elaborated in detail here.

Embodiment 12

In this embodiment, there is provided an air conditioner, including an outdoor unit and the indoor unit as described in the above embodiment 11 which is connected to the outdoor unit, thus allowing heat exchange for air by the indoor unit through refrigerant interaction between the outdoor unit and the indoor unit, achieving adjustment of air temperature. The air conditioner in this embodiment has all beneficial advantages as described for the indoor unit as described in the above embodiment 11, which is not elaborated in detail here.

The embodiments of the present disclosure are illustrated above with reference to drawings, which improve utilization of the heat exchanger fin; facilitate to improving heat exchange efficiency and reducing energy consumption; and reduce manufacture cost by decreasing the material waste.

In present disclosure, terms such as "first", "second" and "third" are used herein for purposes of description and are not intended to indicate or imply relative importance; term "a plurality of" means two or more than two this features, unless specified otherwise; terms "mounted", "connected", "coupled", "fixed" and the like are used broadly, and may be, for example, fixed connections, detachable connections, or integrated connections; may also be direct connections or indirect connections via intervening structures.

In the description of the present disclosure, it should be understood that, the terms indicating orientation or position relationship such as "above", "below", "left", "right", "front", "rear" and the like should be construed to refer to the orientation or position relationship as described or as shown in the drawings. These terms are merely for convenience and concision of description and do not alone indicate or imply that the device or unit referred to must have a particular orientation or must be configured or operated in a particular orientation. Thus, it cannot be understood to limit the present disclosure.

Reference throughout this specification to "an embodiment", "some embodiments", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples", in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A heat exchanger fin, comprising:

a fin body, comprising an air outlet contour line arranged at one side and an air inlet contour line arranged at other side, and provided with refrigerant pipe mounting holes; wherein the fin body is curved from a center of the heat exchanger fin to two ends of the heat exchanger fin;

a distance between the air inlet contour line and the air outlet contour line of the fin body, on a straight line of a curvature radius of the air outlet contour line of the fin body or on a straight line of a curvature radius of the air inlet contour line of the fin body, decreases from the center of the heat exchanger fin to the two ends of the heat exchanger fin;

the fin body is concave in a direction from an air inlet side to an air outlet side of the fin body;

a distance between adjacent refrigerant pipe mounting holes is positively correlated with a diameter of the refrigerant pipe mounting holes: both the distance between adjacent refrigerant pipe mounting holes and the diameter of the refrigerant pipe mounting holes decreases from the center of the heat exchanger fin to the two ends of the heat exchanger fin; and number of the refrigerant pipe mounting holes is decreased from the center to the two ends of the heat exchanger fin.

2. The heat exchanger fin according to claim 1, wherein the fin body is a one-piece structure.

3. The heat exchanger fin according to claim 1, wherein at least part of the air outlet contour line of one heat exchanger fin overlaps with the air inlet contour line of an adjacent heat exchanger fin.

4. The heat exchanger fin according to claim 3, wherein a first end and a second end of the air inlet contour line are connected to the air outlet contour line respectively.

5. The heat exchanger fin according to claim 4, wherein a straight line corresponding to the maximum distance extends along an air inlet direction for the heat exchanger fin.

6. The heat exchanger fin according to claim 5, wherein the fin body is symmetrical relative to the straight line corresponding to the maximum distance.

7. The heat exchanger fin according to claim 5, wherein a length of the air inlet contour line at one side of the straight line corresponding to the maximum distance is greater than a length of the air inlet contour line at the other side of the straight line corresponding to the maximum distance.

8. The heat exchanger fin according to claim 7, wherein the air outlet contour line comprises five are segments connected in sequence, and curvatures decrease from the center to the two ends of the heat exchanger fin.

9. The heat exchanger fin according to claim 5, wherein a plane where an air inlet direction for the fin body is located is a first plane, and a plane which is perpendicular to the first plane is a second plane; and the fin body is of a larger projection size on the second plane than that on the first plane.

10. The heat exchanger fin according to claim 9, wherein the fin body is of a larger projection size on the second plane at one side of the straight line corresponding to the maximum distance than that on the second plane at the other side of the straight line corresponding to the maximum distance.

11. The heat exchanger fin according to claim 9, wherein the fin body is of a larger projection size on the first plane at one side of the straight line corresponding to the maximum distance than that on the first plane at the other side of the straight line corresponding to the maximum distance.

12. The heat exchanger fin according to claim 1, wherein the heat exchanger fin is formed as an equidistant region at the center, and the distance between the air inlet contour line and the air outlet contour line is equal within the equidistant region.

13. The heat exchanger fin according to claim 12, wherein the air inlet contour line and the air outlet contour line within the equidistant region are any one or any combination of an arc and a straight line.

14. The heat exchanger fin according to claim 1, wherein an inner diameter of the refrigerant pipe mounting holes are decreased from the center to the two ends of the heat exchanger fin.

15. The heat exchanger fin according to claim 1, wherein the distance between the air inlet contour line and the air outlet contour line of the fin body corresponding to the refrigerant pipe mounting holes are positively correlated with an internal diameter of each refrigerant pipe mounting hole, on a straight line of a curvature radius of the air outlet contour line of the fin body or on a straight line of a curvature radius of the air inlet contour line of the fin body: both the distance between the air inlet contour line and the air outlet contour line of the fin body and the internal diameter of each refrigerant pipe mounting hole decreases from the center of the heat exchanger fin to the two ends of the heat exchanger fin.

16. The heat exchanger fin according to claim 1, wherein an internal diameter of each refrigerant pipe mounting hole is linear-positively correlated with a distance of circle centers between any two adjacent refrigerant pipe mounting holes, on a straight line of a curvature radius of the air outlet contour line of the fin body or on a straight line of a curvature radius of the air inlet contour line of the fin body: both the internal diameter of each refrigerant pipe mounting hole and the distance of circle centers between any two adjacent refrigerant pipe mounting holes decreases from the center of the heat exchanger fin to the two ends of the heat exchanger fin.

17. A heat exchanger, comprising:

at least one heat exchanger fin as defined in claim 1, which are arranged side by side, wherein a distance between any two adjacent heat exchanger fins is not less than a preset interval; and a refrigerant pipe, wherein a pipe diameter of the refrigerant pipe fits with a size of a refrigerant pipe mounting hole of the heat exchanger fin, and the refrigerant pipe passes through the refrigerant pipe mounting hole.

18. An indoor unit, comprising:

a shell, provided with an air inlet and an air outlet;

a fan, arranged inside the shell; and a heat exchanger as defined in claim 17, arranged inside the shell and arranged corresponding to the fan.

19. An air conditioner, comprising:

an outdoor unit; and an indoor unit as defined in claim 18, connected to the outdoor unit.

* * * * *